US006325341B1

(12) United States Patent
Brown

(10) Patent No.: US 6,325,341 B1
(45) Date of Patent: Dec. 4, 2001

(54) BAG HOLDER DEVICE

(76) Inventor: Richard A. Brown, 1214 W. 2nd St., Pella, IA (US) 50219

( * ) Notice: Subject to any disclaimer, the term of this patent is extended or adjusted under 35 U.S.C. 154(b) by 0 days.

(21) Appl. No.: 09/559,251

(22) Filed: Apr. 27, 2000

(51) Int. Cl.[7] ..... B65B 67/04
(52) U.S. Cl. ..... 248/99; 248/175
(58) Field of Search ..... 248/99, 95, 97, 248/100, 175

(56) References Cited

U.S. PATENT DOCUMENTS

| | | | | |
|---|---|---|---|---|
| Re. 33,842 | * | 3/1992 | Ebentheuer | 248/97 |
| 2,451,829 | * | 10/1948 | Hightower | 248/100 |
| 4,467,989 | * | 8/1984 | Stroh | 248/97 |
| 4,690,357 | * | 9/1987 | Webster | 248/99 |
| 4,893,769 | * | 1/1990 | Rotelli | 248/97 |
| 5,188,244 | * | 2/1993 | Hollstegge | 248/95 X |
| 5,799,908 | * | 9/1998 | Downs | 248/97 |
| 5,967,469 | * | 10/1999 | Wade | 248/100 |

* cited by examiner

*Primary Examiner*—Ramon O. Ramirez
(74) *Attorney, Agent, or Firm*—Michael S. Neustal

(57) ABSTRACT

A bag holder device for retaining a bag in an upright and open position for allowing an individual to fill the bag with debris. The inventive device includes a first support member and a second support member that are extendible into a ground surface. The first support member includes a pair of first legs, a pair of first arm members extending from the first legs, and a first bar member extending between the first arm members. The second support member includes a pair of second legs, a pair of second arm members extending from the second legs, and a second bar member extending between the second arm members. The first bar member and the second bar member are surrounded by a first engaging member and a second engaging member respectively for engaging a paper bag. A first board having first apertures and a second board having second apertures is included for receiving the first support member and the second support member upon hard surfaces such as concrete or asphalt.

19 Claims, 6 Drawing Sheets

BAG HOLDER DEVICE

BACKGROUND OF THE INVENTION

1. Field of the Invention

The present invention relates generally to bag support devices and more specifically it relates to a bag holder device for retaining a bag in an upright and open position for allowing an individual to fill the bag with debris.

2. Description of the Prior Art

Bag support devices have been in use for years. Typically, a bag support device comprises a tubular container having an upper opening, at least one side wall and a floor for receiving the bag.

Conventional bag support devices are not suitable for use within a backyard or other remote area because of their bulkiness. In addition, conventional bag support devices are often times not large enough to receive a large bag typically utilized for receiving leaves and other lawn debris.

Examples of patented bag devices include U.S. Pat. No. 4,953,815 to Beymer et al.; U.S. Pat. No. 5,799,908 to Downs; U.S. Pat. No. 4,332,361 to McClellan; U.S. Pat. No. 5,924,657 to Bach; U.S. Pat. No. 5,570,862 to Nugent; U.S. Pat. No. 5,060,893 to Halbert;

U.S. Pat. No. 3,905,406 to Cruse; U.S. Pat. No. 4,307,861 to Simpson et al.; U.S. Pat. No. 5,738,315 to Kent, Jr.; U.S. Pat. No. 4,759,518 to Yardas; U.S. Pat. No. 5,868,364 to MacMillan; U.S. Pat. No. 4,440,430 to Kruse which are all illustrative of such prior art.

While these devices may be suitable for the particular purpose to which they address, they are not as suitable for retaining a bag in an upright and open position for allowing an individual to fill the bag with debris. Conventional bag support devices are not suitable for use in remote areas for supporting a bag.

In these respects, the bag holder device according to the present invention substantially departs from the conventional concepts and designs of the prior art, and in so doing provides an apparatus primarily developed for the purpose of retaining a bag in an upright and open position for allowing an individual to fill the bag with debris.

SUMMARY OF THE INVENTION

In view of the foregoing disadvantages inherent in the known types of bag support devices now present in the prior art, the present invention provides a new bag holder device construction wherein the same can be utilized for retaining a bag in an upright and open position for allowing an individual to fill the bag with debris.

The general purpose of the present invention, which will be described subsequently in greater detail, is to provide a new bag holder device that has many of the advantages of the bag support devices mentioned heretofore and many novel features that result in a new bag holder device which is not anticipated, rendered obvious, suggested, or even implied by any of the prior art bag support devices, either alone or in any combination thereof.

To attain this, the present invention generally comprises a first support member and a second support member that are extendible into a ground surface. The first support member includes a pair of first legs, a pair of first arm members extending from the first legs, and a first bar member extending between the first arm members.

The second support member includes a pair of second legs, a pair of second arm members extending from the second legs, and a second bar member extending between the second arm members. The first bar member and the second bar member are surrounded by a first engaging member and a second engaging member respectively for engaging a paper bag. A first board having first apertures and a second board having second apertures is included for receiving the first support member and the second support member upon hard surfaces such as concrete or asphalt.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a bag holder device that will overcome the shortcomings of the prior art devices.

A second object is to provide a bag holder device for retaining a bag in an upright and open position for allowing an individual to fill the bag with debris.

Another object is to provide a bag holder device that is compact for storage during extended travel.

An additional object is to provide a bag holder device that allows an individual to fill a bag without the assistance of another individual.

A further object is to provide a bag holder device that reduces spillage from the bag because of the bag tipping over.

Another object is to provide a bag holder device that is capable of supporting cloth, plastic and paper bags.

A further object is to provide a bag holder device that can be stored upon a wall in a flat condition.

An additional object is to provide a bag holder device that fits various sizes of bags.

Another object is to provide a bag holder device that firmly holds the bag in an open position to allow light debris such as leaves and grass to flow to the lower portion of the bag without interference.

A further object is to provide a bag holder device that retains both plastic and paper bags without requiring additional clips or attaching devices.

Another object is to provide a bag holder device that can be utilized upon ground or hard surfaces.

An additional object is to provide a bag holder device that allows adjustment of the height by extending the legs into the ground the appropriate distance.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
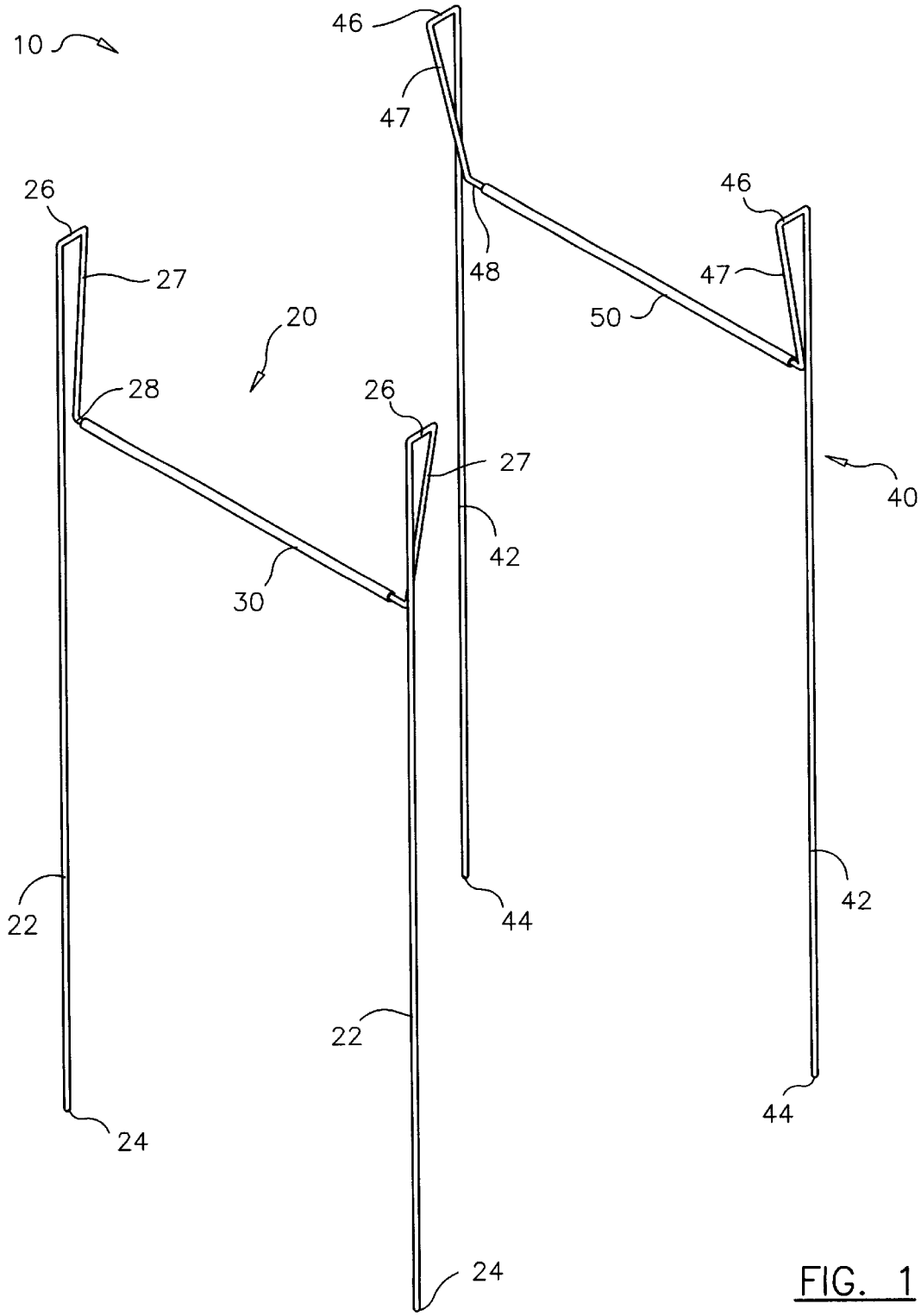
FIG. 1 is an upper perspective view of the present invention.

Turning now descriptively to the drawings, in which similar reference characters denote similar elements throughout the several views, FIGS. 1 through 7 illustrate a bag holder device 10, which comprises a first support member 20 and a second support member 40 that are extendible into a ground 12 surface. The first support member 20 includes a pair of first legs 22, a pair of first arm members 27 extending from the first legs 22, and a first bar member 28 extending between the first arm members 27. The second support member 40 includes a pair of second legs 42, a pair of second arm members 47 extending from the second legs 42, and a second bar member 48 extending between the second arm members 47. The first bar member 28 land the second bar member 48 are surrounded by a first engaging member 30 and a second engaging member 50 respectively for engaging a paper bag 16. A first board 60 having first apertures 62 and a second board 70 having second apertures 72 is included for receiving the first support member 20 and the second support member 40 upon hard surfaces such as concrete or asphalt.

Figure 2:
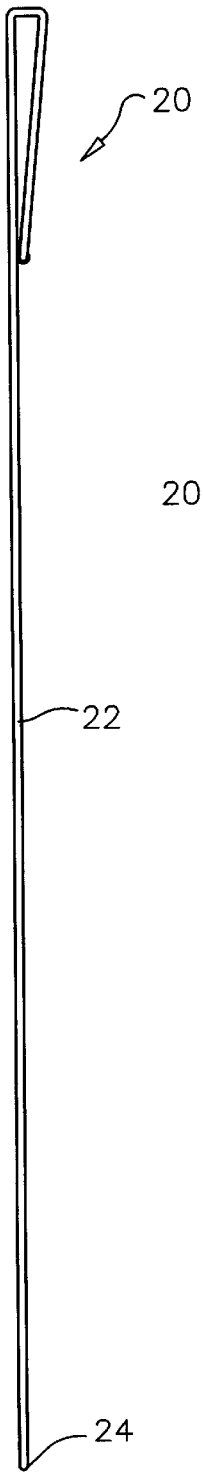
FIG. 2 is a side view of the first support member.
Figure 3:
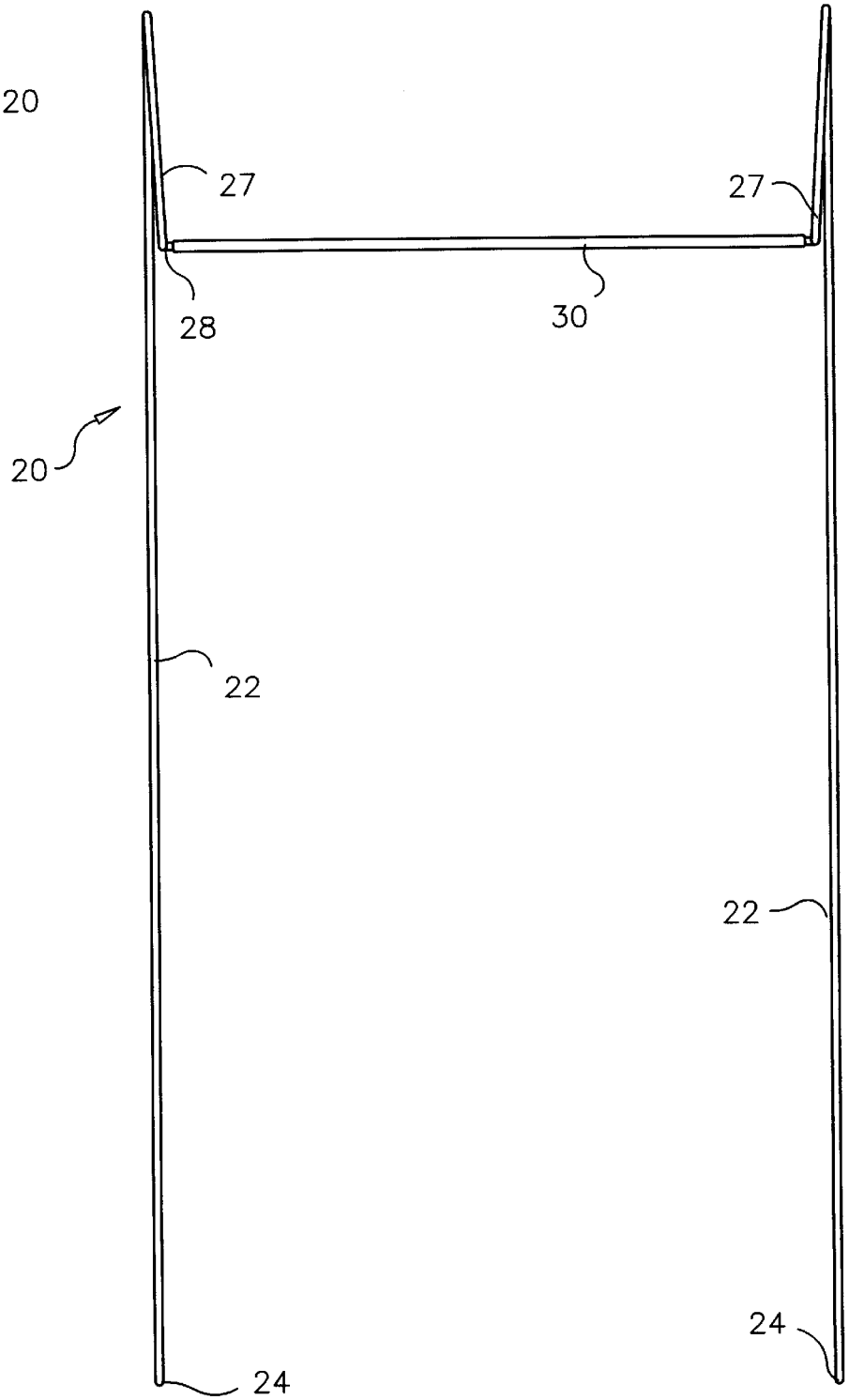
FIG. 3 is a front view of the first support member.
Figure 4:
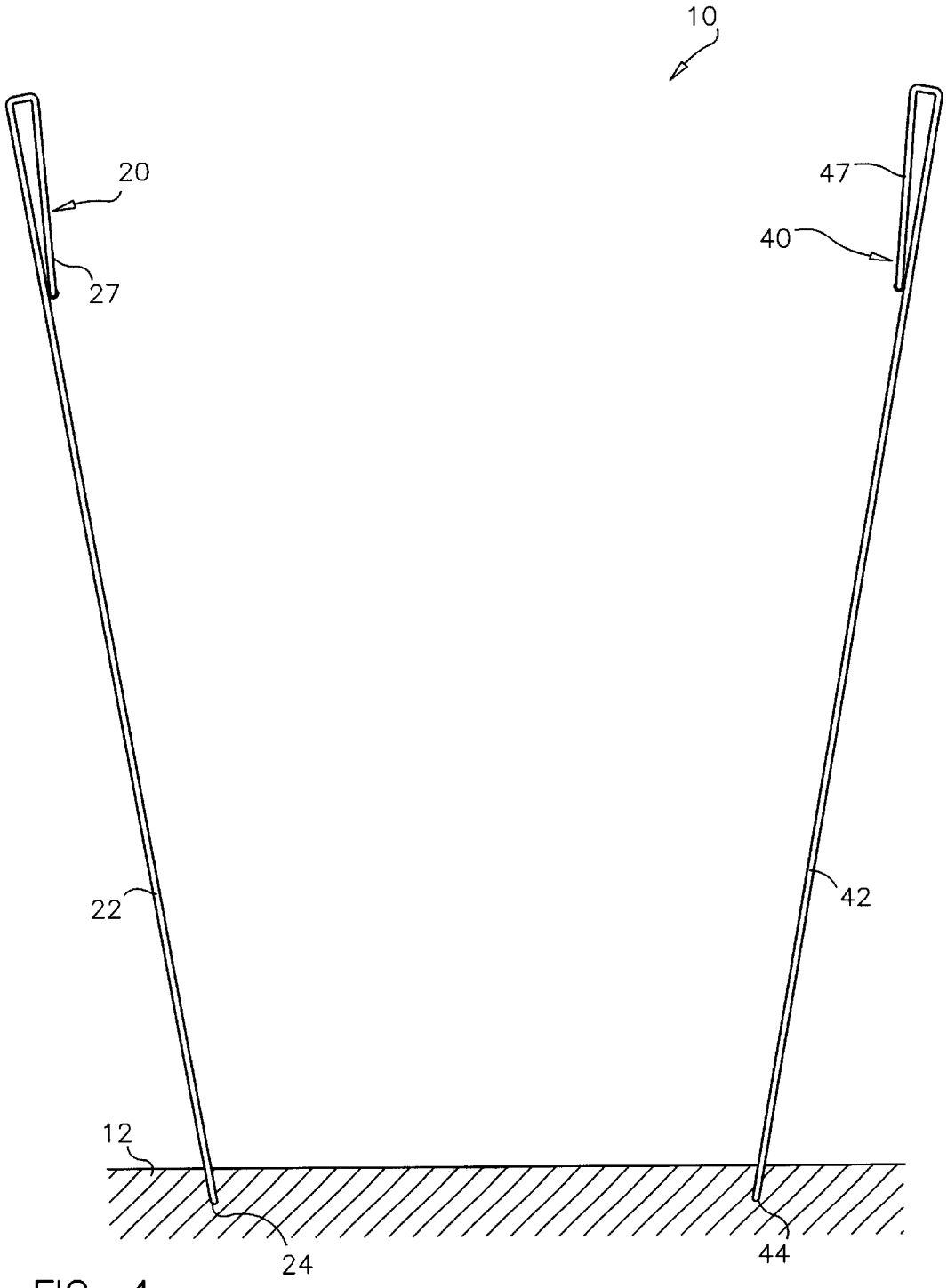
FIG. 4 is a side view of the first support member and the second support member extended into the ground at an angle.

The first support member 20 is preferably constructed of a resilient material such metal or plastic. As shown in FIGS. 1 through 6 of the drawings, the first support member 20 is comprised of a pair of first legs 22 having an elongate structure. The first legs 22 are preferably of a length approximately the height of the bag to be supported. The first legs 22 are preferably a straight structure, however it can be appreciated that various other shapes may be incorporated into the first legs 22. The first legs 22 includes first spiked ends 24 for penetrating the ground 12 for supporting the first support member 20 as shown in FIGS. 1, 3 and 4 of the drawings.

As best shown in FIG. 1 of the drawings, a corresponding pair of first extended members 26 extend orthogonally from the first legs 22 opposite of the first spiked ends 24. As further shown in FIG. 1 of the drawings, a pair of corresponding first arm members 27 extend from the first extended members 26 opposite of the first legs 22. The first arm members 27 are angled inwardly toward the first legs 22 as best shown in FIGS. 1, 2 and 4 of the drawings.

As shown in FIGS. 1 and 3 of the drawings, a first bar member 28 extends between the distal ends of the first arm members 27. As sown in FIGS. 1 and 3 of the drawings, a first engaging member 30 surrounds a portion of the first bar member 28 for engaging a portion of a paper bag 16. The first engaging member 30 is constructed of a gripping material such as rubber or plastic.

Figure 5:
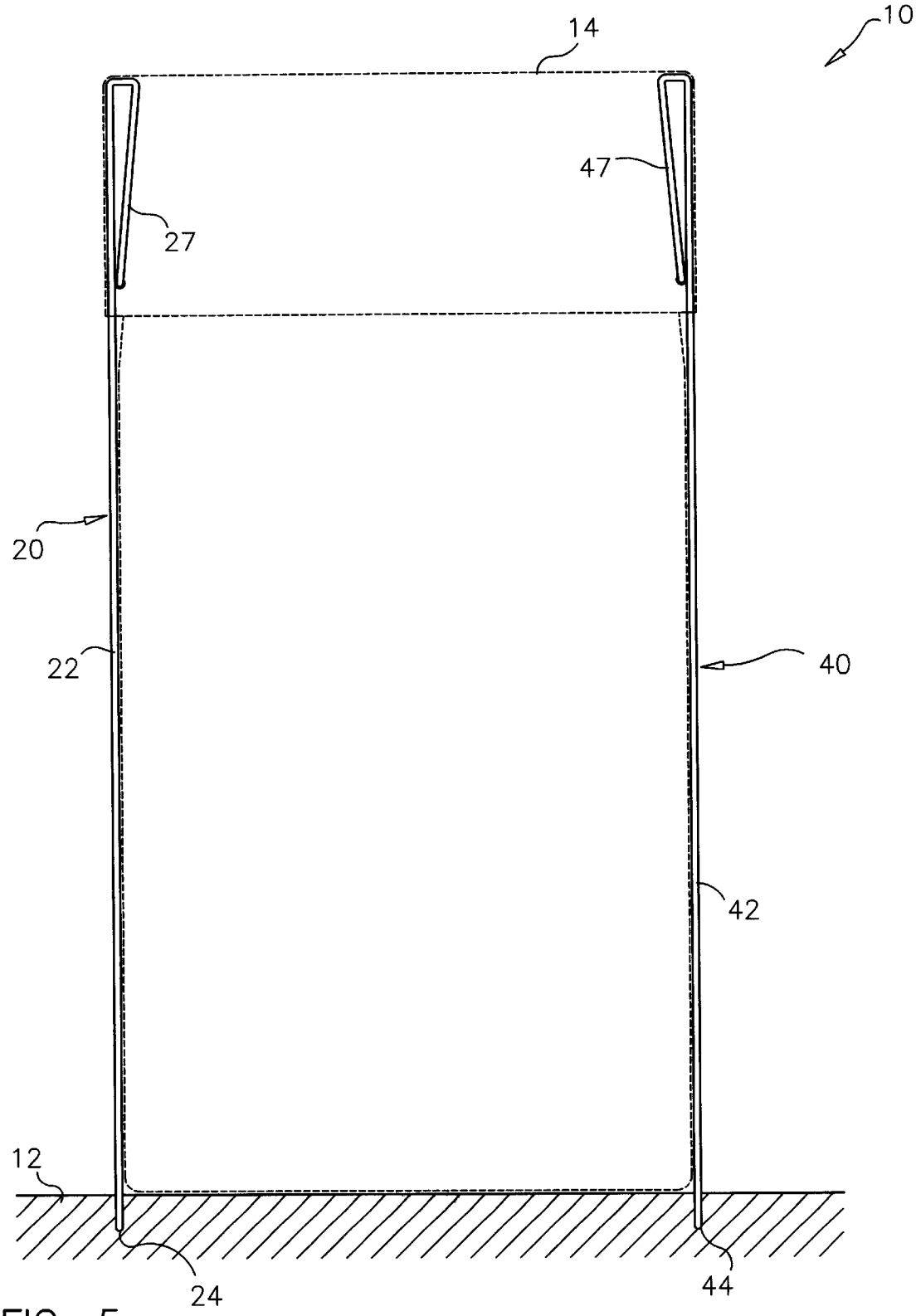
FIG. 5 is a side view of the present invention retaining and supporting a plastic bag.
Figure 6:
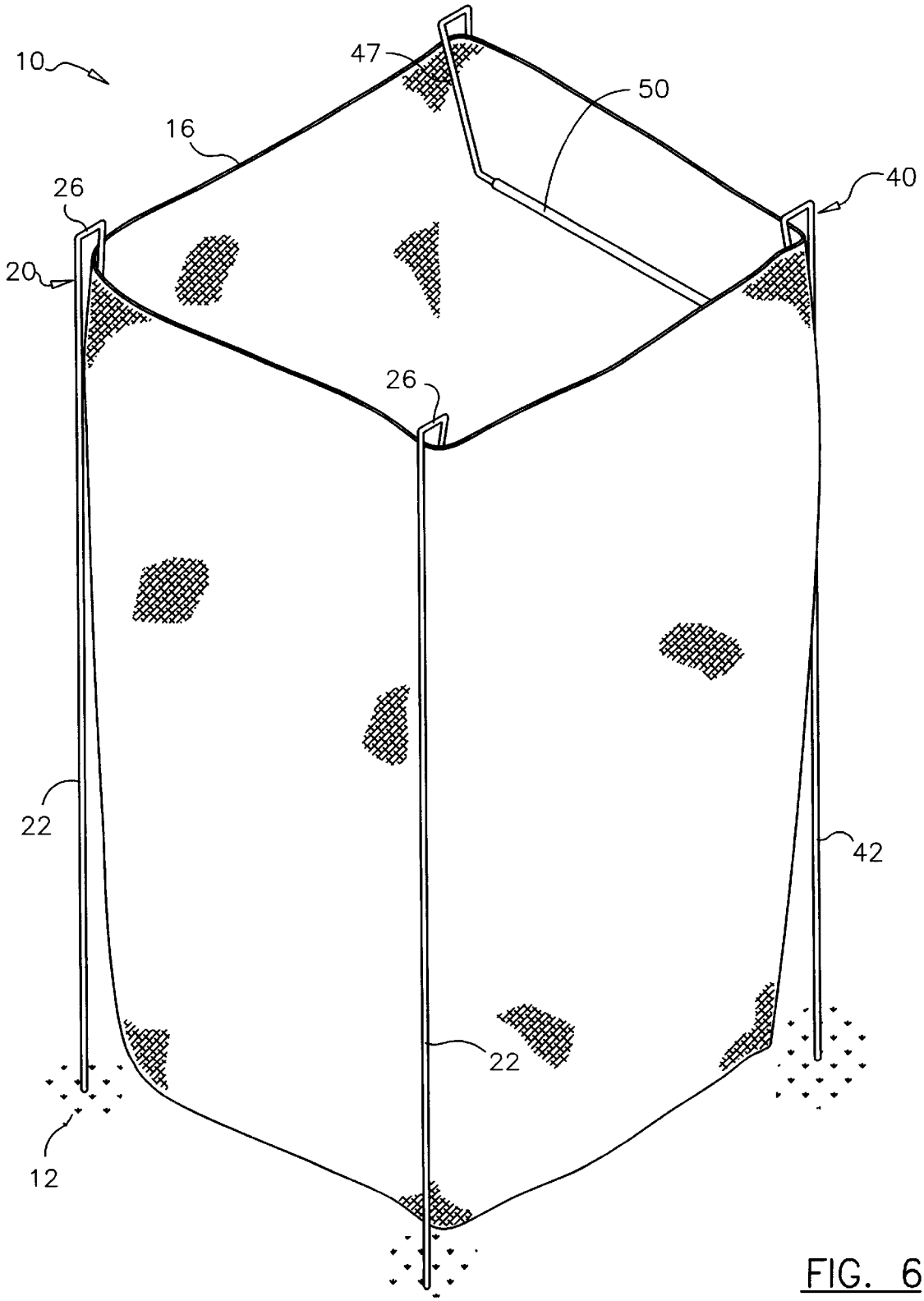
FIG. 6 is an upper perspective view of the present invention retaining and supporting a paper bag.

As shown in FIGS. 1 through 6 of the drawings, the second support member 40 is similar in structure as the first support member 20. The second support member 40 is preferably constructed of a resilient material such metal or plastic. As shown in FIGS. 1 through 6 of the drawings, the second support member 40 is comprised of a pair of second legs 42 having an elongate structure. The second legs 42 are preferably of a length approximately the height of the bag to be supported. The second legs 42 are preferably a straight structure, however it can be appreciated that various other shapes may be incorporated into the second legs 42. The second legs 42 includes second spiked ends 44 for penetrating the ground 12 for supporting the second support member 40 as shown in FIGS. 1, 6 and 4 of the drawings.

As best shown in FIG. 1 of the drawings, a corresponding pair of second extended members 46 extend orthogonally from the second legs 42 opposite of the second spiked ends 44. As further shown in FIG. 1 of the drawings, a pair of corresponding second arm members 47 extend from the second extended members 46 opposite of the second legs 42. The second arm members 47 are angled inwardly toward the second legs 42 as best shown in FIGS. 1, 5 and 4 of the drawings.

As shown in FIGS. 1 and 6 of the drawings, a second bar member 48 extends between the distal ends of the second arm members 47. As sown in FIGS. 1 and 6 of the drawings, a second engaging member 50 surrounds a portion of the second bar member 48 for engaging a portion of a paper bag 16. The second engaging member 50 is constructed of a gripping material such as rubber or plastic.

Figure 7:
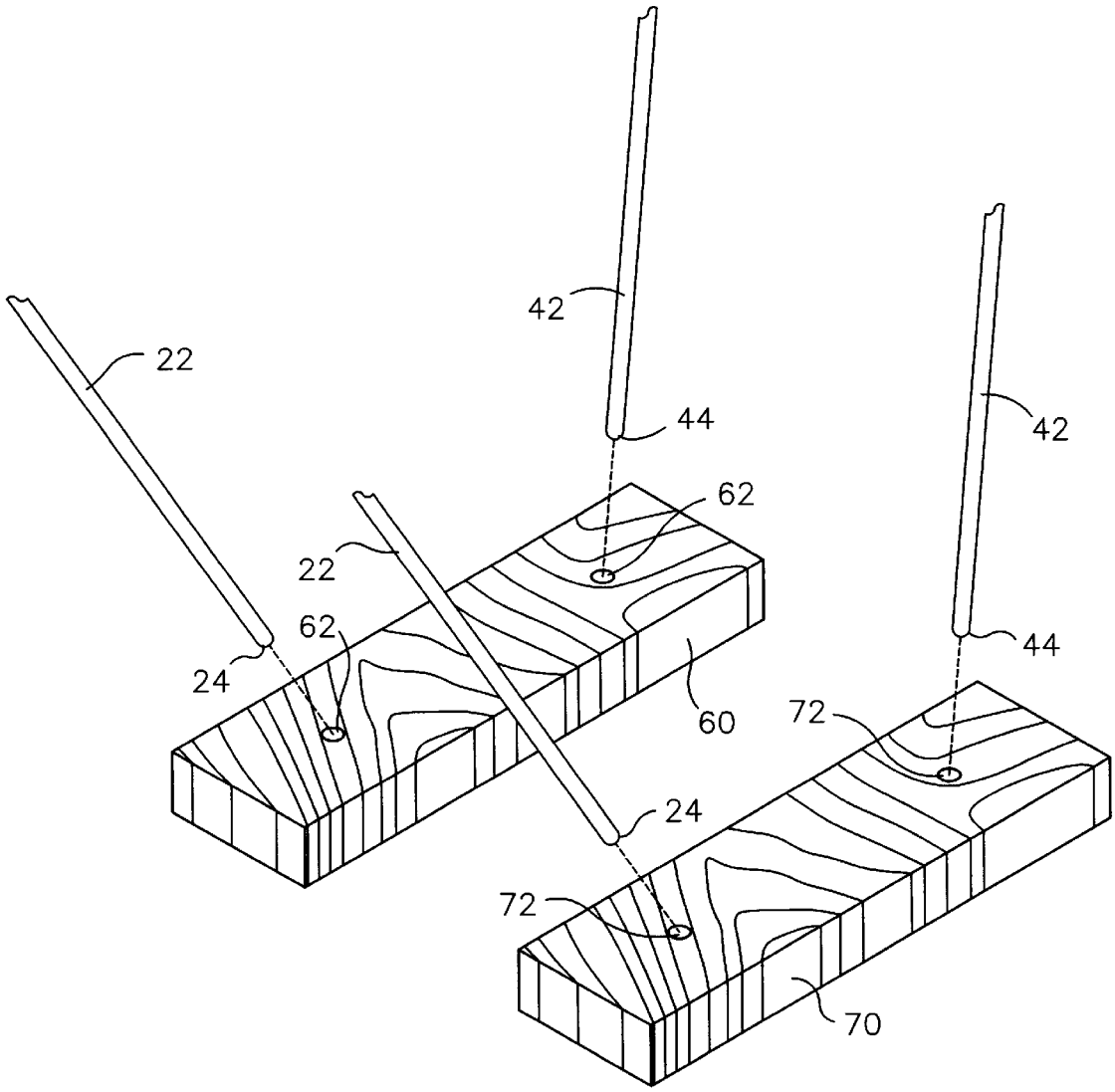
FIG. 7 is an upper perspective view of board members.

As shown in FIG. 7 of the drawings, if the bag holder device 10 is to be utilized upon a hard surface such as cement or asphalt, the user may utilize a first board 60 and a second board 70 containing first apertures 62 and second apertures 72 respectively. The first apertures 62 and the second apertures 72 extend into the boards 60, 70 at an angle for receiving the legs 22, 42 as shown in FIG. 7 of the drawings.

In use, the user positions the first support member 20 and the second support member 40 into the ground 12 extending away from each other as best shown in FIG. 4 of the drawings. If the user is utilizing the boards 60, 70, the user then inserts the legs 22, 42 into the apertures 62, 72 of the boards 60, 70 so that the support members 20, 40 extend away from one another. If the user is utilizing a paper bag 16, the user manipulates the first bar member 28 so that the upper portion of the paper bag 16 may be inserted between the first legs 22 and the first bar member 28 as shown in FIG. 6 of the drawings. The first engaging member 30 grips the interior surface of the paper bag 16. The user then pulls the paper bag 16 toward the second support member 40 and positions the upper portion of the paper bag 16 between the second bar member 48 and the second legs 42. The second engaging member 50 engages the interior of the paper bag 16 opposite of the first engaging member 30. The outward force applied to the paper bag 16 by the support members 20, 40 maintains the paper bag 16 in a taut state thereby maintaining the upper portion of the paper bag 16 in an open position and maintained upright while receiving debris such as leaves, grass or garbage.

If the user is utilizing a plastic bag 14, the user positions the legs 22, 42 of the support members 20, 40 as stated previously. The user then positions the plastic bag 14 between the support members 20, 40 as shown in FIG. 5 of the drawings. The user then draws the upper portions of the support members 20, 40 toward one another and then positions the upper portion of the plastic bag 14 over the outer portion of the support members 20, 40. The outward force applied by the support members 20, 40 to the plastic bag 14 maintains the plastic bag 14 in a taut and upright position with the upper opening maintained in an open position for receiving debris such as leaves, grass or garbage.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bag holder device having a pair of support members, each of said support members comprising:

a pair of legs having an upper end and a lower end;

a pair of arm members attached to said upper end of said pair of legs, wherein said pair of arm members are angled inwardly toward said pair of legs; and a bar member extending between said pair of arm members.

2. The bag holder device of claim 1, including:

a first board having a pair of first apertures; and a second board having a pair of second apertures for receiving said pair of legs of said pair of support members.

3. The bag holder device of claim 1, including an engaging member surrounding said bar member.

4. The bag holder device of claim 3, wherein said engaging member is comprised of a gripping material.

5. The bag holder device of claim 1, wherein said lower end of said pair of legs are spiked.

6. The bag holder device of claim 1, wherein said pair of legs are comprised of resilient material.

7. The bag holder device of claim 1, including an engaging member surrounding said bar member.

8. The bag holder device of claim 7, wherein said engaging member is comprised of a gripping material.

9. The bag holder device of claim 8, wherein said lower end of said pair of legs are spiked.

10. A bag holder device having a pair of support members, each of said support members comprising:

a pair of legs having an upper end and a lower end, wherein said lower end of said pair of legs are spiked;

a pair of arm members attached to said upper end of said pair of legs;

a bar member extending between said pair of arm members; and a first board having a pair of first apertures, and a second board having a pair of second apertures for receiving said pair of legs of said pair of support members.

11. A bag holder device having a pair of support members, each of said support members comprising:

a pair of legs having an upper end and a lower end;

a pair of extended members extending orthogonally from said upper end;

a pair of arm members attached to said pair of extended members, wherein said pair of arm members are angled inwardly toward said pair of legs; and a bar member extending between said pair of arm members.

12. The bag holder device of claim 11, wherein said pair of legs are comprised of resilient material.

13. The bag holder device of claim 11, including an engaging member surrounding said bar member.

14. The bag holder device of claim 13, wherein said engaging member is comprised of a gripping material.

15. The bag holder device of claim 11, wherein said lower end of said pair of legs are spiked.

16. The bag holder device of claim 11, including:

a first board having a pair of first apertures; and a second board having a pair of second apertures for receiving said pair of legs of said pair of support members.

17. The bag holder device of claim 16, including an engaging member surrounding said bar member.

18. The bag holder device of claim 17, wherein said engaging member is comprised of a gripping material.

19. The bag holder device of claim 18, wherein said lower end of said pair of legs are spiked.

* * * * *